US005521321A

United States Patent [19]

Liu

[11] Patent Number: 5,521,321

[45] Date of Patent: May 28, 1996

[54] FLASHER SWITCH WITH A MECHANICAL MUSIC MECHANISM

[75] Inventor: Yao T. Liu, Taipei, Taiwan

[73] Assignee: Kyooh Precision Industry Co., Ltd., Taipei, Taiwan

[21] Appl. No.: 324,090

[22] Filed: Oct. 14, 1994

[51] Int. Cl.[6] ..... G10F 1/06

[52] U.S. Cl. ..... 84/95.1; 84/95.2

[58] Field of Search ..... 84/95.1, 95.2, 84/94.1, 94.2, 464 R, 464 A

[56] References Cited

U.S. PATENT DOCUMENTS 2,728,258 12/1955 Stegner ..... 84/95.2

5,157,217 10/1992 Feng ..... 84/95.2

*Primary Examiner*—Steven L. Stephan
*Assistant Examiner*—Cassandra C. Spyrou
*Attorney, Agent, or Firm*—Pro-Techtor International

[57] ABSTRACT

The present invention is a new design using a mechanical musical structure to serve a flasher switch. It consists of a base, a musical scale device, a triggering device, a driver and a flasher switch. The above-described devices are installed on the base. When the driver drives the triggering device to rotate, the convex points on the metal tubing of the triggering device would rotate and touch the musical scale rods of the musical scale device. Due to intermittent contact between the musical scale rods and the convex points, the device releases music and triggers the switch to serve a flasher.

1 Claim, 5 Drawing Sheets

FLASHER SWITCH WITH A MECHANICAL MUSIC MECHANISM

BACKGROUND OF THE INVENTION (a) Field of the Invention

The present invention relates to a mechanical music mechanism, especially to a mechanical music mechanism that is used to serve a flasher switch.

(b) Description of the Prior Art

A conventional mechanical music mechanism, such as a music bell, consists of a base (10), a musical scale device (20), a triggering device (30) and a driver (40) which is installed on the base (10). The musical scale device (20) is a comb structure with certain musical scale rods (21) on top that can be triggered to release music. The triggering device (30) enables the musical scale device (20) to transmit music. It is comprised of an axial rod (31), a metal tubing (32) with certain convex points (33) on its surface and a plastic roller (35). The plastic roller (35), embraced by the metal tubing (32), is fixed on the axial rod (31). On one side of the plastic roller (35) is a gear (34). The axial rod (31) is fixed to a support (11) on the base (10). As a result, the gear (34) drives the plastic roller (35) to rotate the metal tubing (30). Based upon the theory discussed above, the driver (40) drives the triggering device (30) to rotate, using a hair spring as a motivating force. (The hair spring is installed in the driver (40), which is not shown in the drawings.)

With the above-described mechanism, the hair spring of the driver (40) generates a force that drives the gear (34) of the triggering device (30) to rotate the triggering device (30). The metal tubing (32) of the triggering device (30) also rotates as a result. The convex points (33) of the trigger device (30) touches the musical scale rods (21) of the musical scale device (20) intermittently, thereby releasing music. Products using this structure include dancers in music boxes and music carousals. However, traditional music boxes only have simple music and movements. Therefore, the inventor has attempted to improve the design.

SUMMARY OF THE INVENTION

The present invention provides a mechanical music mechanism, which is used to serve a flasher switch that can be added to gifts like music bells, music boxes or music carousals. The new design makes the gifts more lively. The mechanism that accomplishes the aim consists of a base, a musical scale device, a triggering device, a driver and a flasher switch. The musical scale device is installed above the base. It is a comb structure that can release music and has certain tuning scale rods on top. The triggering device is installed on the base also and enables the musical scale device to release music. It is comprised of an axial rod, a plastic roller, a metal tubing and convex points on the metal tubing. The metal tubing embraces the plastic roller while the plastic roller is fixed on the axial rod. On one side of the plastic roller is a gear. The axial rod is installed on the support above the base. The driver drives the triggering device to rotate by using a hair spring to create a force. The on-off flash switching device is connected to the triggering device and the musical scale device.

Given the above mentioned structure, when the driver drives the triggering device to rotate, the convex points on the metal tubing of the triggering device rotates as a result and touches the musical scale rods of the musical scale device. Therefore, the musical scale rods contact the convex points intermittently. It enables the on-off device connected to the musical scale device and the trigger device to create a flasher switch.

BRIEF DESCRIPTION OF THE DRAWINGS

The drawings disclose an illustrative embodiment of the present invention, which serves to exemplify the various advantages and objects hereof, and are as follows.

DETAILED DESCRIPTION OF THE PREFERRED EMBODIMENT

Figure 1:
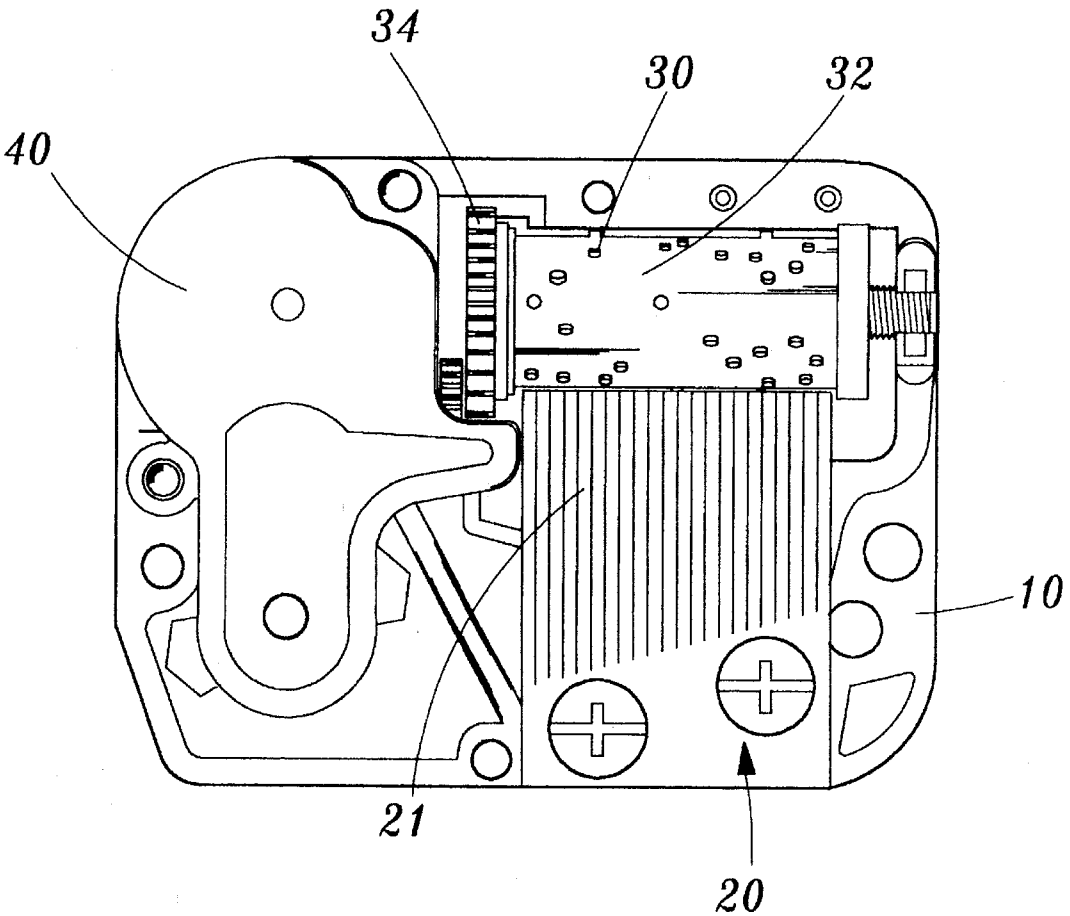
PRIOR ART FIG. 1
FIG. 1 is a diagrammatic drawing of a general mechanical music bell.
Figure 2:
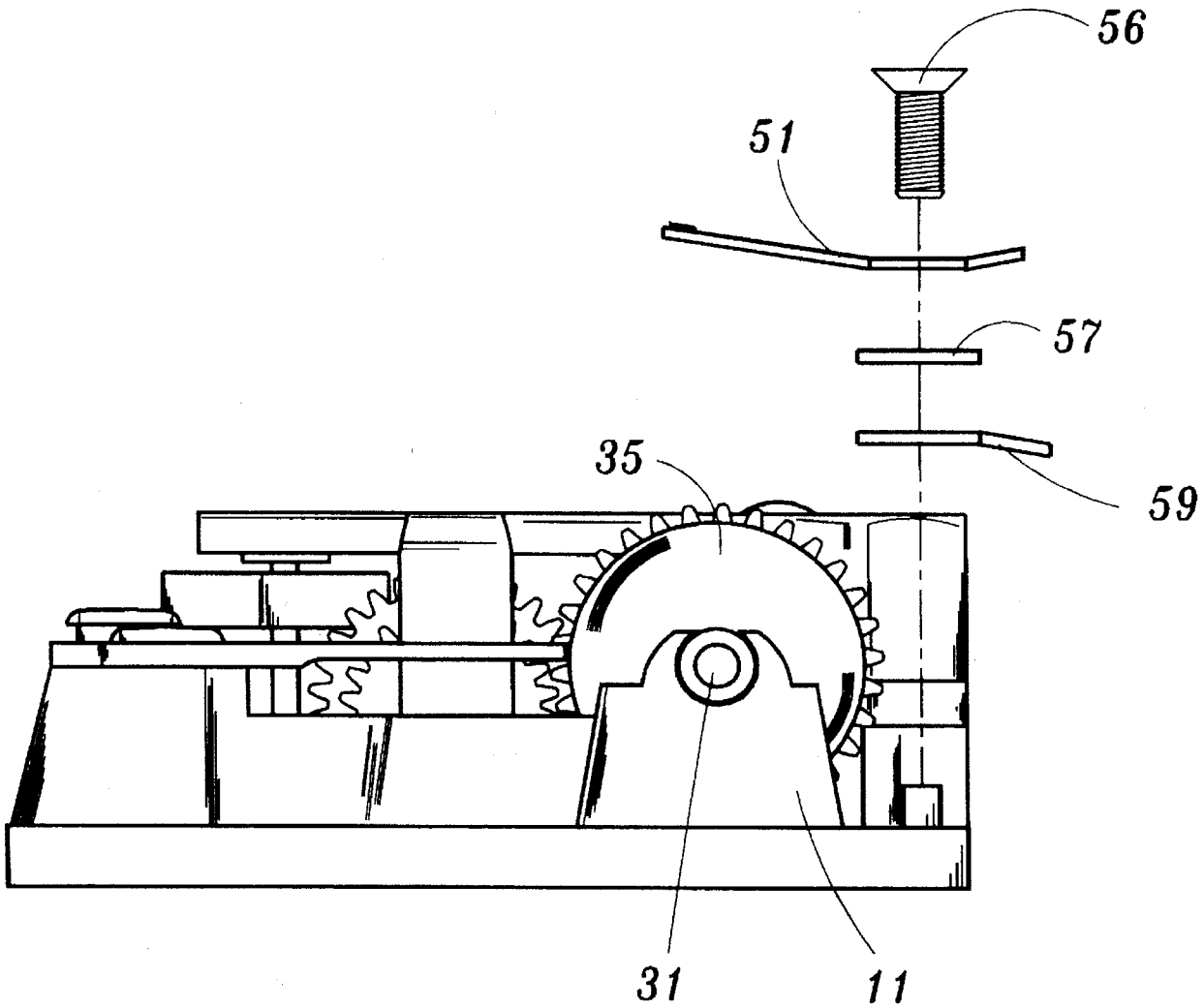
FIG. 2 is a perspective diagrammatic drawing of the assembly of the switch of the present invention.
Figure 3:
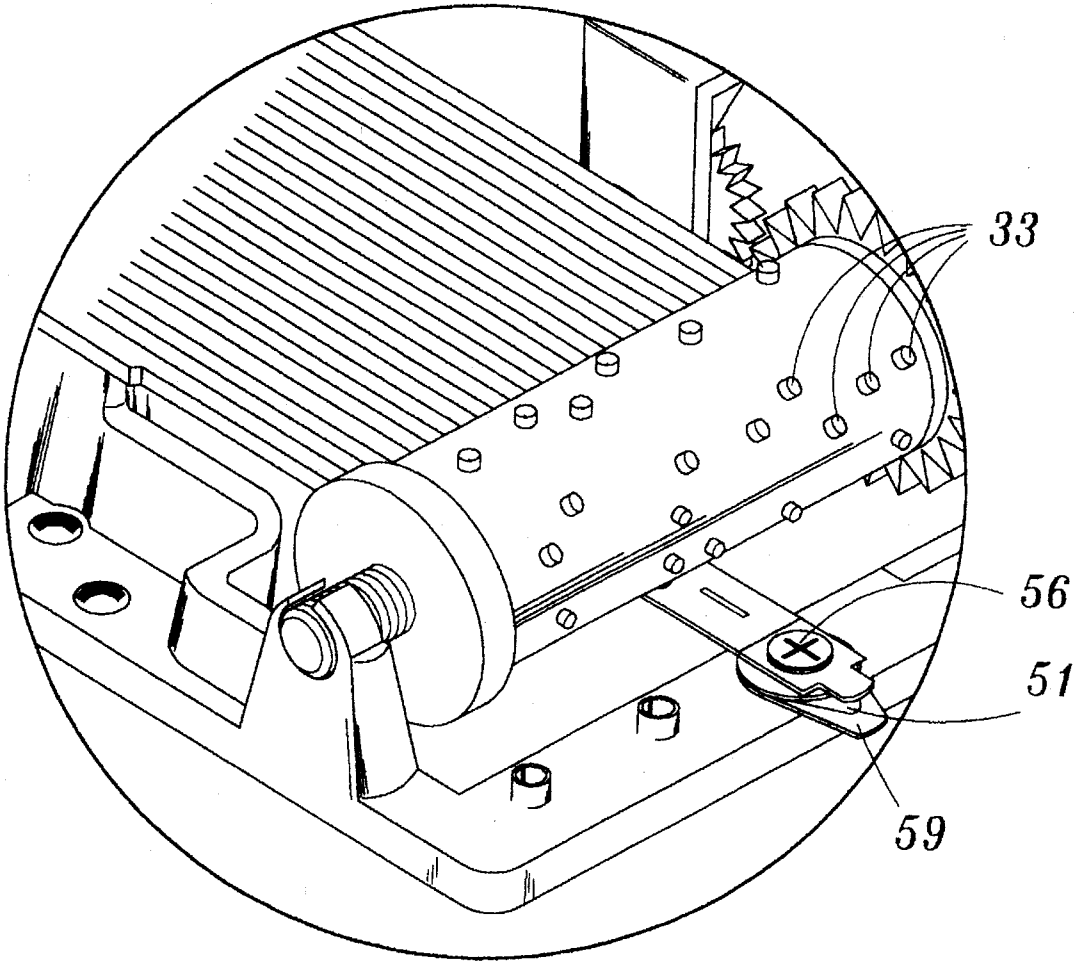
FIG. 3 is a partial perspective diagrammatic drawing of the assembled switch of the present invention.

As shown in FIG. 1, the present invention's mechanical music mechanism consists of a base (10), a musical scale device (20), a triggering device (30) and a driver (40). It is discussed above and therefore would not be repeated here. The present invention's flasher switch (50) consists of a sender connecting piece (51) that contacts the triggering device (30), a receiver connecting piece (59) that contacts the base (10), a lighting component (52), a source voltage (53) and circuit (54). The circuit (54) is connected to the sender connecting piece (51) on one end. The sender connecting piece (51) comes in touch with a metal tubing (32) and transmits the signal of the circuit (54) to the triggering device (30). The receiver connecting piece (59) on the other end of the circuit (54) receives the signal from the triggering device (30) through the musical scale device (20). Besides, the lighting component (52) and the source voltage (53) are connected in order to the circuit (54) so that the lighting component (52) would create flash. The lighting component (52) may be a LED.

The lighting component (52) can be replaced by a sound device (not shown in the drawings) to transmit sound when coordinating with the rotating metal tubing (32). The circuit (54) has a switching component (55) on top that can control the movement of the circuit device (50).

The sender connecting piece (51) and the receiver connecting piece (59) are fixed above the base (10) by a fixing component. To prevent short circuit of the sender connecting piece (58) and the receiver connecting piece (59), an insulator (57) is placed between the two pieces. The sender connecting piece (51) can be a piece of angular spring. The fixing component (56) can be a plastic screw.

The flasher switch (50) is created by the signal sender connecting piece (51) and the signal receiver connecting piece (59) connected through the triggering device (30) and the musical scale device (20). When the driver (40) rotates the gear (34) of the triggering device (30), the sender connecting piece (51) receives the signal of the circuit (54) and sends the signal to the metal tubing (32). Since the metal tubing (32) is separated by a plastic roller (35), the metal tubing (32) would not directly contact the metal base (10) and thus avoids the loss of signal. Music is created by the convex points (33) on the metal tubing (32) rolling to touch the musical scale rods (21) of the musical scale device (20).

The cycle is completed by the musical scale device (20) sending the signal back to the circuit (54) through the receiver connecting piece (59). The present invention uses the intermittent contacts between the convex points (33) and the musical scale rods (21) to create a switching function. Flashing is generated by the intermittent contacts between the musical scale device (20) and the switching device of the triggering device (30). Signal is sent from the receiving device (59) to the switching device (50) of the triggering device (30).

Figure 4:
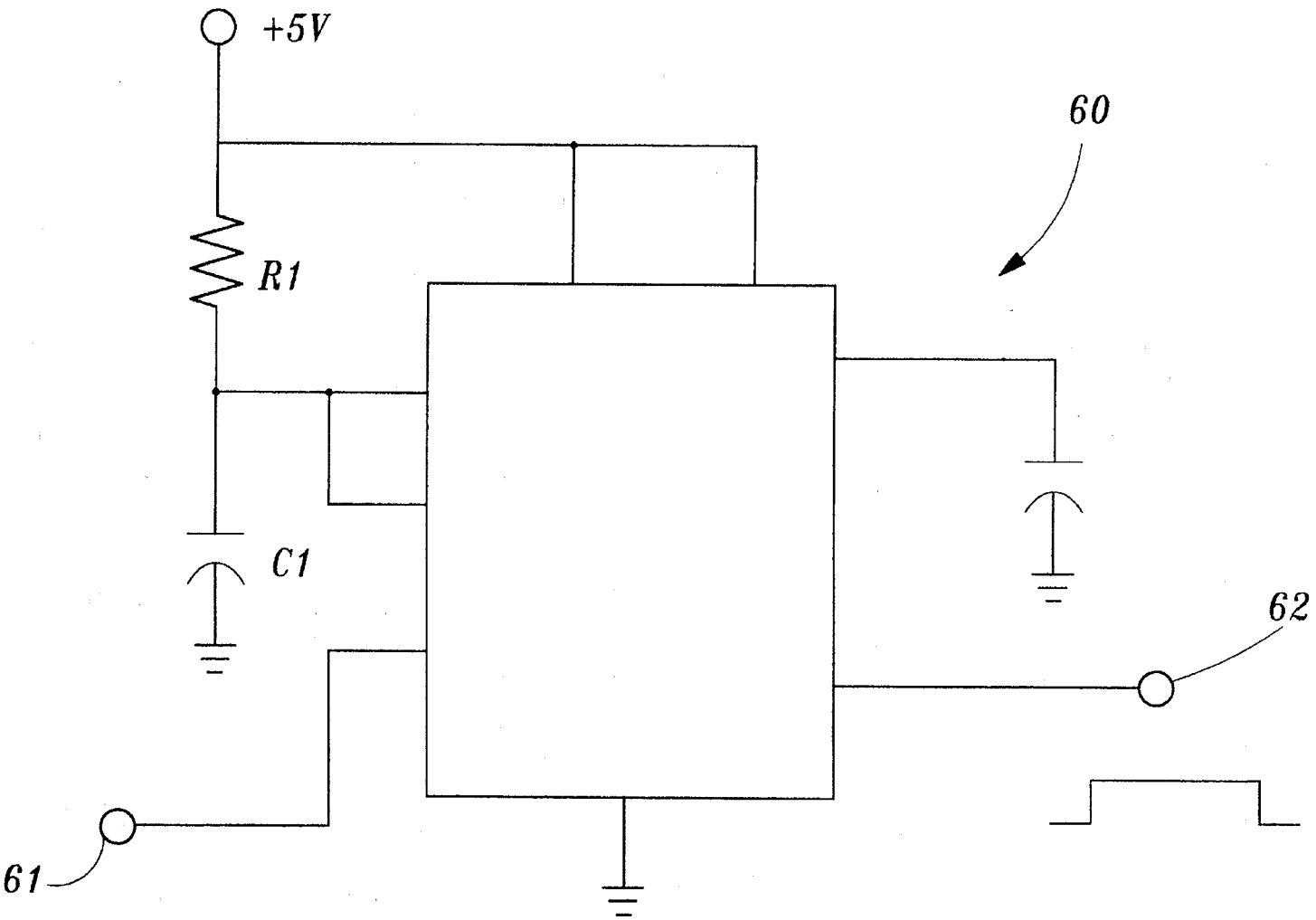
FIG. 4 is a schematic drawing of the present invention's single static vibrator.
Figure 5:
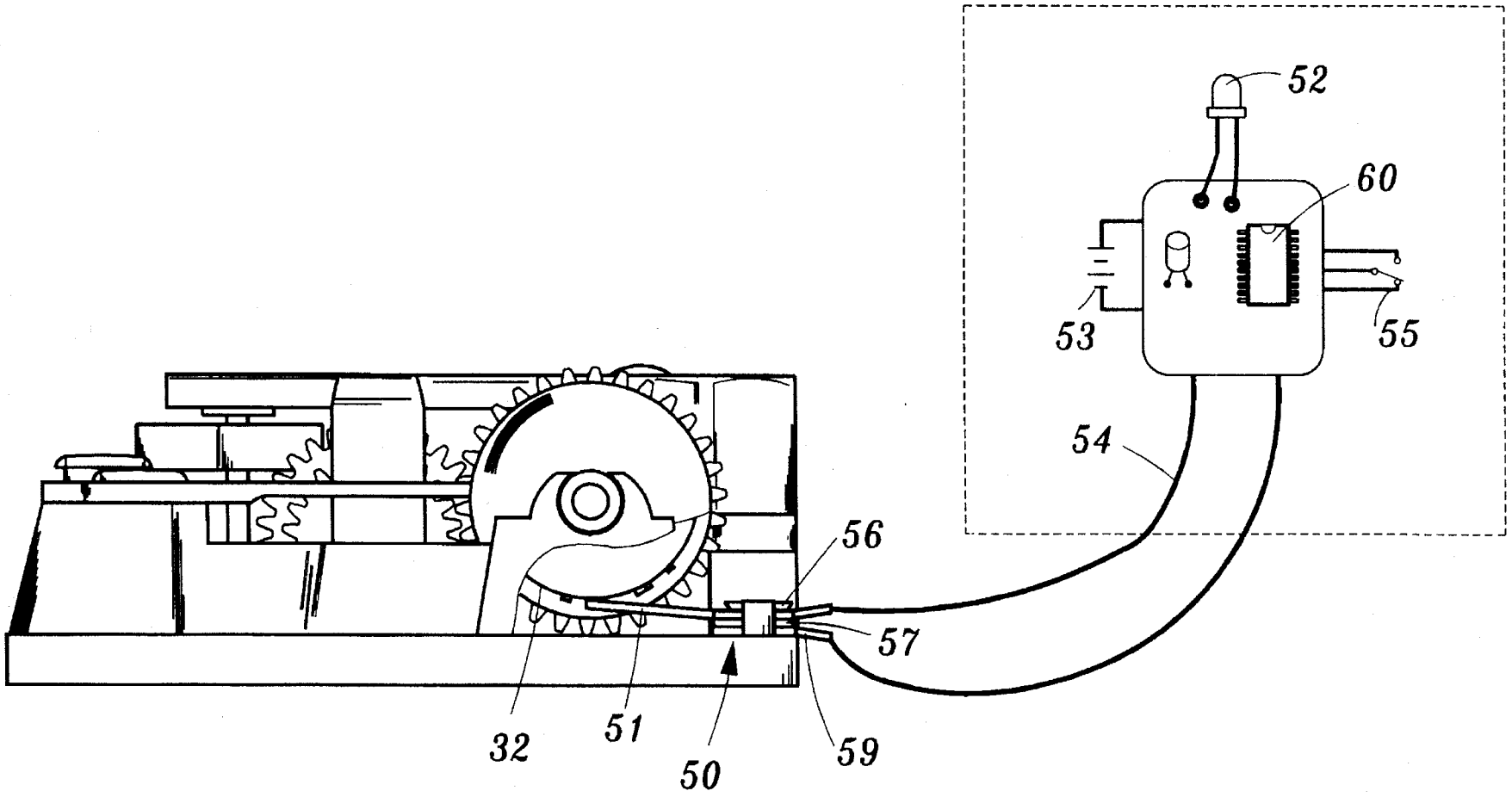
FIG. 5 is a perspective diagrammatic drawing of the assembled switch of the present invention.

As indicated in FIG. 4, a single static vibrator can be added to the flasher switch (50). The single static vibrator (60) is a pulse generator. The generation is started by adding a triggering signal to a trigger input end (61). It usually occurs when the input wave moves from high to low voltage. When the input end (61) is triggered, the output end (62) turns to high voltage. At this time, the charge circuit is closed, and a capacitor is charged up to two-third of the source voltage. The output end then turns to have a negative voltage, and the capacitor C1 will have a zero voltage.

When the input end (61) is triggered, the capacitor C1 passes through a resistor R1 to be charged up to two-third of the source voltage. When the cycle is over, the capacitor would release electricity to ground. When the cycle continues, the output is positive and remains positive after the input end is triggered. The triggering pulse should be narrower than the pulse output time. The triggering process would not be automatically repeated. Only with a new triggering signal can a new pulse be generated. The triggering movement can be started by the above mentioned sender connecting piece (51) and the receiver connecting piece (59).

The single static vibrator (60) changes the long signal from the musical scale rods (21) to a single triggering signal. It provides more convenience to the switch (50) and enables the lighting component (52) to accomplish the flashing effect.

The single static vibrator (60)'s main function is that when the triggering device (40) loses its momentum, the lighting component (52) would not have any light even when the metal tubing (32) and the musical scale rods (21) are in the state of closed circuit. It helps save energy.

In conclusion, the present invention adds a flasher switch that turns on and off with the movement of the music bell and the music. The design is not found in any existing music boxes. It is a unique and new switch in coordination with a mechanical music mechanism. It is superior in technology to and more practical than existing designs. Therefore, the inventor would like to claim a patent for the present invention in accordance with the law.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exists in the invention disclosed.

What is claimed is:

1. A mechanical music box mechanism comprising:

a base;

means for producing a musical scale, said means for producing a musical scale including musical scale rods;

means to trigger said means for a producing music scale, said triggering means comprising an axial rod affixed to said base; a plastic roller fixed on said axial rod; a metal tube affixed to said plastic roller, said metal tube including convex points thereon, said convex points intermittently contacting said musical scale rods; and a gear connected to a first side of the plastic roller;

driving means comprising a spring to force said gear to rotate, thereby rotating the metal tube such that said convex points intermittently contact the musical scale rods;

an electric circuit;

flash switching means to pass a signal from said electric circuit consecutively through said metal tube, said musical scale rods, and said base and returning to said electric circuit when said convex points contact said musical scale rods; said flash switching means comprising a sender connecting piece connected to said electric circuit and to said metal tubing; a receiver connecting piece connected to said electric circuit and to said base.

* * * * *